US010180017B2

(12) United States Patent
Ewing et al.

(10) Patent No.: US 10,180,017 B2
(45) Date of Patent: Jan. 15, 2019

(54) SECURITY DEVICE WITH REUSABLE BASE MEMBER

(71) Applicants: Brent Ewing, Roscoe, IL (US); Thomas O. Nagel, Rockford, IL (US); Chan Chor Man, Tai Po (HK)

(72) Inventors: Brent Ewing, Roscoe, IL (US); Thomas O. Nagel, Rockford, IL (US); Chan Chor Man, Tai Po (HK)

(73) Assignee: Southern Imperial LLC, Rockford, IL (US)

( * ) Notice: Subject to any disclaimer, the term of this patent is extended or adjusted under 35 U.S.C. 154(b) by 232 days.

(21) Appl. No.: 15/176,740

(22) Filed: Jun. 8, 2016

(65) Prior Publication Data

US 2016/0356064 A1 Dec. 8, 2016

Related U.S. Application Data

(60) Provisional application No. 62/172,627, filed on Jun. 8, 2015.

(51) Int. Cl.
*E05B 73/00* (2006.01)

(52) U.S. Cl.
CPC ..... *E05B 73/0029* (2013.01); *E05B 73/0005* (2013.01); *E05B 73/0017* (2013.01)

(58) Field of Classification Search
CPC ..... E05B 67/003; E05B 67/006; E05B 73/00; E05B 73/0005; E05B 73/0011; E05B 73/0017; E05B 73/0029
See application file for complete search history.

(56) References Cited

U.S. PATENT DOCUMENTS

| | | | | |
|---|---|---|---|---|
| 7,522,048 | B2 * | 4/2009 | Belden, Jr. | E05B 73/0017 242/382 |
| 7,543,466 | B2 * | 6/2009 | Loughlin | E05B 67/003 70/14 |
| 7,984,629 | B2 * | 7/2011 | Xiaobin | A45C 13/20 242/382 |
| 8,528,372 | B2 * | 9/2013 | Nilsson | E05B 45/005 242/382 |
| 8,640,509 | B2 * | 2/2014 | Will | E05B 45/005 70/14 |
| 8,938,997 | B2 * | 1/2015 | Piccoli | E05B 73/0029 70/14 |
| 9,169,670 | B2 * | 10/2015 | Shute | E05B 45/005 |
| 9,404,291 | B1 * | 8/2016 | White | E05B 45/005 |
| 9,524,626 | B2 * | 12/2016 | Bruhwiler | E05B 73/0029 |
| 2009/0289798 | A1 * | 11/2009 | Yang | G08B 13/1463 340/572.8 |
| 2010/0171621 | A1 * | 7/2010 | Yang | G08B 13/1463 340/572.9 |

* cited by examiner

*Primary Examiner* — Christopher J Boswell
(74) *Attorney, Agent, or Firm* — Reinhart Boerner Van Deuren P.C.

(57) ABSTRACT

A security device and its associate base are provided. The base includes a cable having a free end which is routed through the base and around an item of retail merchandise. When tension is applied to the cable, the base actuates a depressible button of an anti-theft component of the security device mounted to the base.

20 Claims, 8 Drawing Sheets

SECURITY DEVICE WITH REUSABLE BASE MEMBER

CROSS-REFERENCE TO RELATED PATENT APPLICATIONS

This patent application claims the benefit of U.S. Provisional Patent Application No. 62/172,627, filed Jun. 8, 2015, the entire teachings and disclosure of which are incorporated herein by reference thereto.

FIELD OF THE INVENTION

This invention generally relates to retail merchandise security devices, and more particularly to retail merchandise security devices which are affixed to retail merchandise to provide anti-theft functionality.

BACKGROUND OF THE INVENTION

There are various methods and devices employed by retail establishments to deter or prevent retail theft. One common approach is to affix a security device directly to a product. Such security devices employ some mode of anti-theft functionality. As one example, it is known to affix an RFID tag directly to a product. A gate is positioned at an exit point of the retail establishment. If the RFID passes through the gate without being deactivated, an alarm will sound. Such RFID tags are oftentimes a small tag with an adhesive back which is adhered directly to a product or its packaging.

However, some packaging does not readily allow for the use of such tags. Indeed, it is not uncommon to utilize shrink wrap on the exterior of a package. Such a packaging arrangement is provided at the source and thus the retail establishment must accommodate their security device to this packaging. Adhesive back RFID tags are not readily employed in such a configuration as they would need to be adhered to the shrink wrap, which can be easily removed in-store by a would be thief.

To address this, there are security devices which are referred to in the art as box wraps. Such box wraps include a central hub housing an anti-theft arrangement and a spool. A cable of fixed length is attached to the spool at both ends thereof. As a result, a loop of cable may be drawn from or taken up by the central hub. The loop is first enlarged and merchandise is passed through the loop. The loop is then taken up by the spool so that the cable is tightly wound around the merchandise such that the security device is effectively affixed to the merchandise. There is typically a locking mechanism within the central hub which prevents the loop from being enlarged again which would otherwise allow for the unwanted removal of the security device. Once activated, the device will sound an alarm if not deactivated, and or, if the device is tampered with, e.g. the cable loop is cut.

While such devices have proven to be effective, they are not without their drawbacks. For example, the loop of cable is a fixed dimension given that the ends of the cable forming the loop are fixedly attached within the central hub. As such, a given box wrap may only accommodate up to a maximum size of retail merchandise. If it is desired to employ such a device on a larger item of merchandise, a retailer must replace the entire security device, including the cable and the central hub, in favor of a device with a central hub and cable loop that can accommodate the larger merchandise.

Further, such box wrap style security devices are typically designed with two loops arranged perpendicular to one another, and are thus designed to accommodate only generally square or rectangular packaging. Yet further, the anti-theft componentry is contained within the central hub. If a retail establishment wishes to change their anti-theft methodology to something which is not compatible with the anti-theft componentry of their existing devices, their existing security devices are rendered entirely obsolete.

As such, there is a need in the art for a security device which can accommodate a broad range of retail packaging sizes rather than being limited to a maximum size of retail merchandise before it must be entirely replaced. There is also a need for a security device that can accommodate retail packaging of various shapes, and a device that is adaptable to differing anti-theft methodologies.

The invention provides such a security device. These and other advantages of the invention, as well as additional inventive features, will be apparent from the description of the invention provided herein.

BRIEF SUMMARY OF THE INVENTION

In one aspect, a security device is provided. An embodiment of a security device accordingly to the invention includes an anti-theft component including a depressible button. The security device also includes a base configured to receive the anti-theft component. The base includes a cable having a free end. The cable is adapted to be routed through the base and tensioned around an item of retail merchandise such that the free end of the cable extends outwardly from the base. The base is configured to depress the depressible button of the anti-theft component when the cable is tensioned around the item of retail merchandise.

In an embodiment according to this aspect, the base includes a cover member and a base plate. The cover member includes a plurality of tracks for routing the cable therethrough. The base plate includes a rocker arm mounted thereto. The rocker arm has a first end, a second end, the first end comprising post, and the second end comprising a tab. The post is configured to depress the depressible button, and wherein the tab is configured to receive a portion of the cable seated tensioned against the tab. The base includes at least one bite element configured for allowing passage of the cable through the at least one bite element in a first direction and prevent passage of the cable through the at least one bite element in a second direction. The at least one bite element can include a plurality of bite elements. The plurality of bite elements can include a first bite element and a second bite element. The first and second bite elements are spaced apart from one another. In such an embodiment, the first and second bite elements extend into one of the plurality of tracks of the cover member.

In an embodiment according to this aspect, the base also includes a pocket formed in the base plate. A passage is also formed in the baseplate and communicates with the pocket. A third bite element is situated adjacent an end of the passage opposite an end of the passage which communicates with the pocket.

In an embodiment according to this aspect, the plurality of tracks includes a first track and a second track. The first track extends along a straight path, and the second track extends along a partially curved track. The first track includes an opening. The tab of the rocker arm extends into the opening of the first track such that the cable will contact the tab.

In another aspect, a base for a security device is provided. An embodiment of the base according to the invention includes a cover member and a base plate. A rocker arm is rotatably mounted between the cover member and the base plate. The base also includes a cable having an end held by the base plate. The cable also has a free end routed through the cover and the base plate. The cable is arranged to exert a downward force on a portion of the rocker arm when in a tensioned state. A post of the rocker arm extends through an aperture formed in the cover member when the cable exerts the downward force on the portion of the rocker arm.

In an embodiment according to this aspect, the cover member includes a plurality of tracks and apertures for routing the cable therethrough. The portion of the rocker arm against which the cable exerts the downward force comprises a tab extending in a generally parallel orientation to the post. The base includes at least one bite element configured for allowing passage of the cable through the at least one bite element in a first direction and prevent passage of the cable through the at least one bite element in a second direction. The at least one bite element can include a plurality of bite elements. The plurality of bite elements can include a first bite element and a second bite element. The first and second bite elements are spaced apart from one another. In such an embodiment, the first and second bite elements extend into one of the plurality of tracks of the cover member.

In an embodiment according to this aspect, the base also includes a pocket formed in the base plate. A passage is also formed in the baseplate and communicates with the pocket. A third bite element is situated adjacent an end of the passage opposite an end of the passage which communicates with the pocket.

In an embodiment according to this aspect, the plurality of tracks includes a first track and a second track. The first track extends along a straight path, and the second track extends along a partially curved track. The first track includes an opening. The tab of the rocker arm extends into the opening of the first track such that the cable will contact the tab.

In yet another aspect, a method for securing an item of retail merchandise is provided. An embodiment of such a method includes installing an anti-theft component onto a base. The method also includes routing a free end of a cable through the base. The method also includes wrapping the free end of the cable around an item of retail merchandise. The method also includes routing the free end of the cable back through the base after the step of wrapping the free end of the cable around the item of retail merchandise. The method also includes tensioning the cable. The method can also include a step of depressing a depressible button of the anti-theft component using the base during or after tensioning the cable is complete. The step of routing the free end of the cable back through the base can include passing the cable through at least one bite element.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
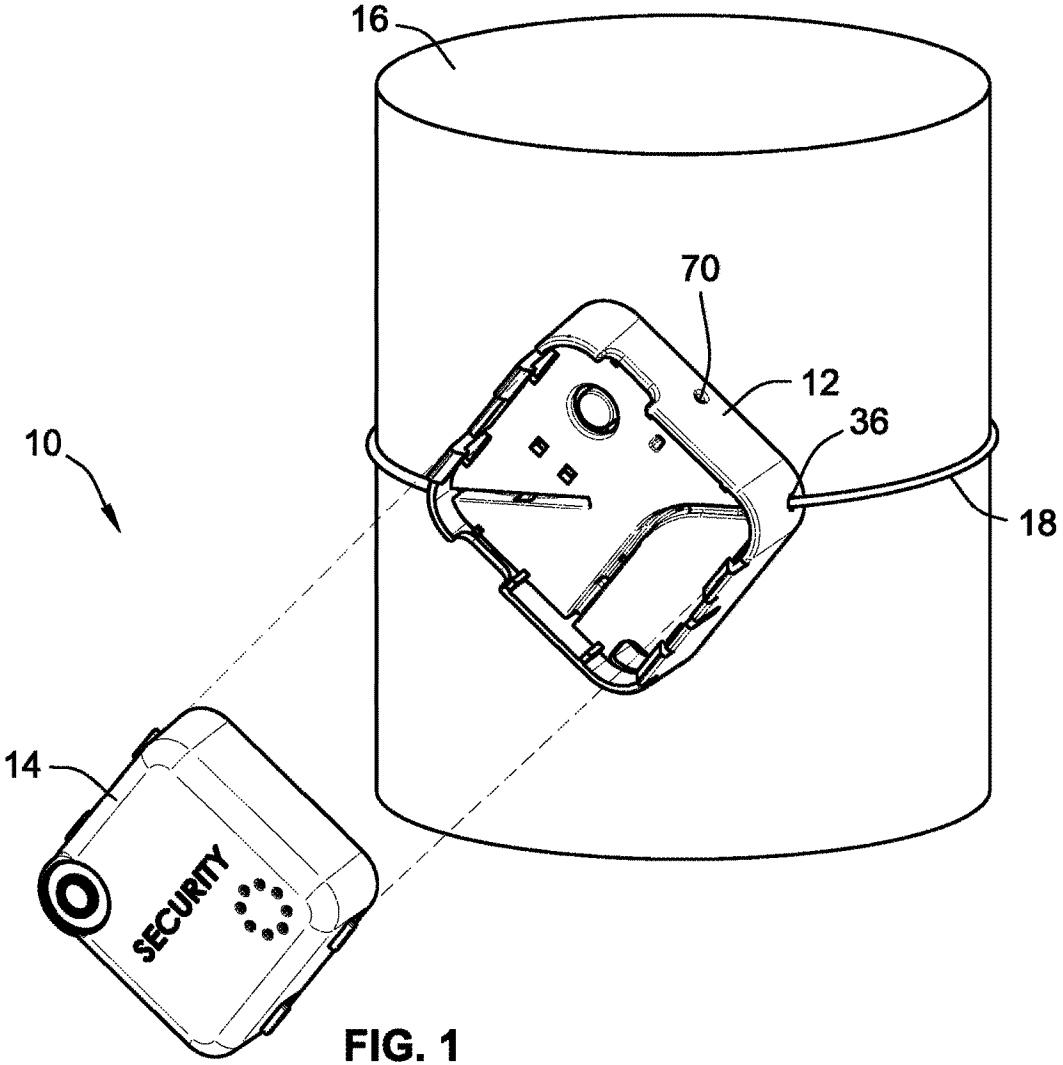
FIG. 1 is a perspective exploded view of the security device installed on an item of retail merchandise.

Turning now to FIG. 1, there is illustrated therein a security device 10 which includes a base 12 and an anti-theft component 14 received by base 12. Security device 10 is attached to an item of merchandise 16 using a cable 18. As will be understood from the following, base 12 is reusable in that cable 18 may be readily replaced with a different length of cable to accommodate larger or smaller merchandise. Further, base 12 is configured to trigger anti-theft component 14 if cable 18 is tampered with in an effort to remove security device 10 from retail merchandise 16. Anti-theft component 14 may take a variety of forms, and is thus shown generally schematically herein. Indeed, anti-theft component 14 may employ RFID technology, or may incorporate motion and/or light sensing technology to detect a potential theft event of merchandise 16.

Figure 2:
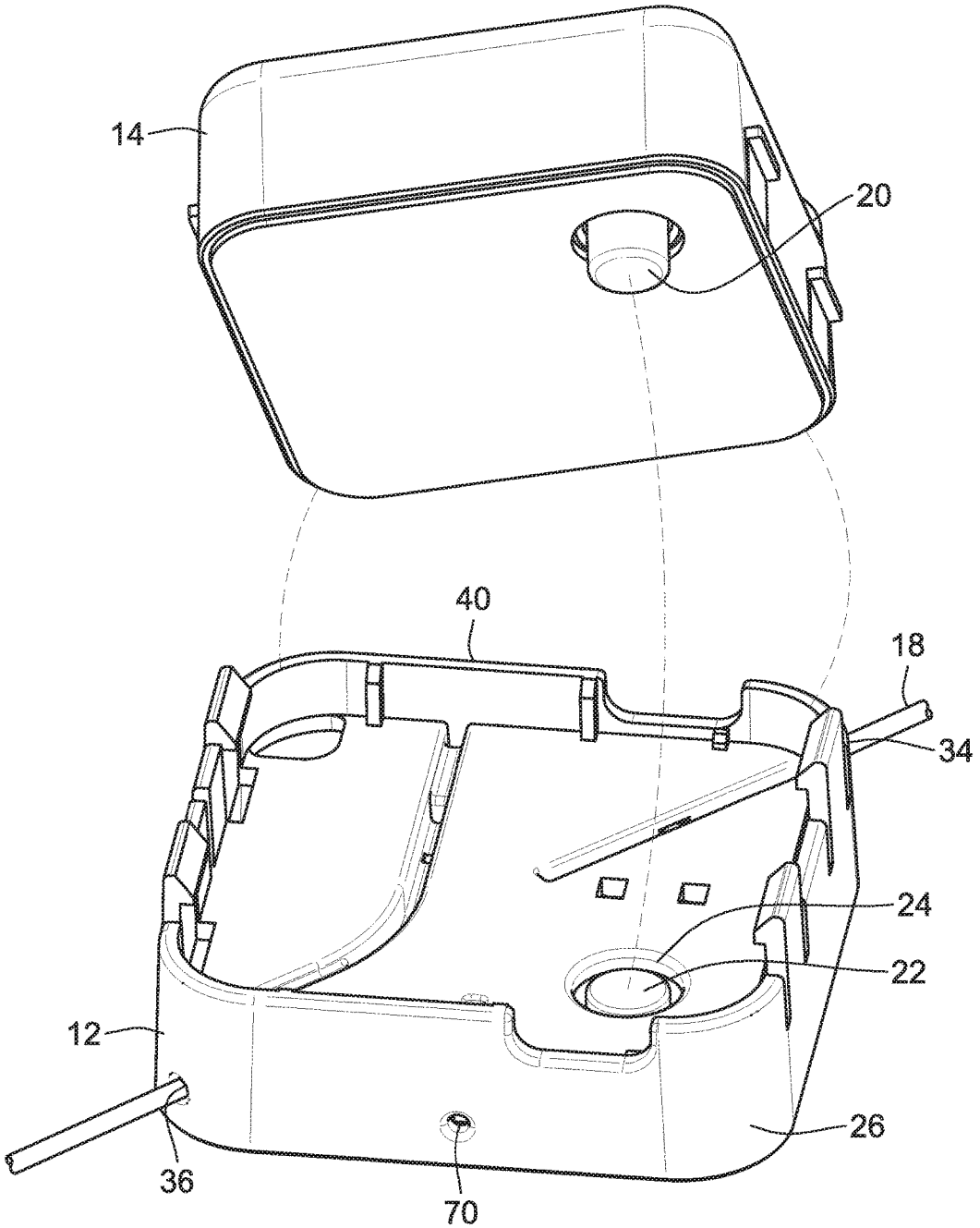
FIG. 2 is another perspective exploded view of the security device of FIG. 1.

Turning now to FIG. 2, anti-theft component 14 is of the type configured to surface mount against an item of retail merchandise. To this end, anti-theft component 14 includes a depressible button 20 on an underside thereof. When anti-theft component 14 is flush-mounted against a surface, typically an item of retail merchandise, button 20 is depressed. However, if anti-theft component 14 is subsequently removed, button 20 will no longer be depressed, which may be indicative of anti-theft component 14 being removed from an item of retail merchandise in a potential theft event. Assuming anti-theft component is an activated condition; it will detect this transition of depressible button 20 from depressed to not depressed, and provide an indication.

In the embodiment shown in FIG. 2, rather than being attached directly to an item of retail merchandise, anti-theft component 14 is attached to base 12 by way of a snap connection using a plurality of tabs on base 12. Button 20 is alignable with a movable post 22 which is exposed through an aperture 24 formed in a cover member 26 of base 12. Indeed, by way of the close snap-fit connection between base 12 and anti-theft component 14, depressible button is positioned directly adjacent post 22. Post 22 thus simulates a mounting surface such as retail merchandise packaging which depressible button 20 would ordinarily encounter. Although not shown, base 12 may include any number of keying features which may correspond to a keying feature on anti-theft component 14. Such keying features may be used to ensure the proper alignment of anti-theft component 14 with base 12, i.e. to ensure that button 20 is aligned with post 22. As one non-limiting example, base 12 may include a projection or key in a specific location which will mate with a corresponding keyway or the like on anti-theft component 14 to thereby only permit one orientation of anti-theft component 14 relative to base 12.

As will be explained in greater detail in the following, when cable 18 is sufficiently tensioned around an item of retail merchandise as shown in FIG. 1, post 22 will move upwardly through aperture 24 and depress button 20 of anti-theft component 14 when the same is installed on base 12. If cable 18 is tampered with and cut a potential theft event, there will no longer be any tension therein and this will cause post 22 to move downwardly through aperture 24. As a result, button 20 will no longer be depressed and anti-theft component 14 will provide its theft notification which may be visual, audible, silent, a signal transmission, or any combination thereof. Such functionality allows for a surface mount-style anti-theft component to operate with base 12, and despite not being surface mounted directly to an item of merchandise, provide its anti-theft functionality.

Figure 3:
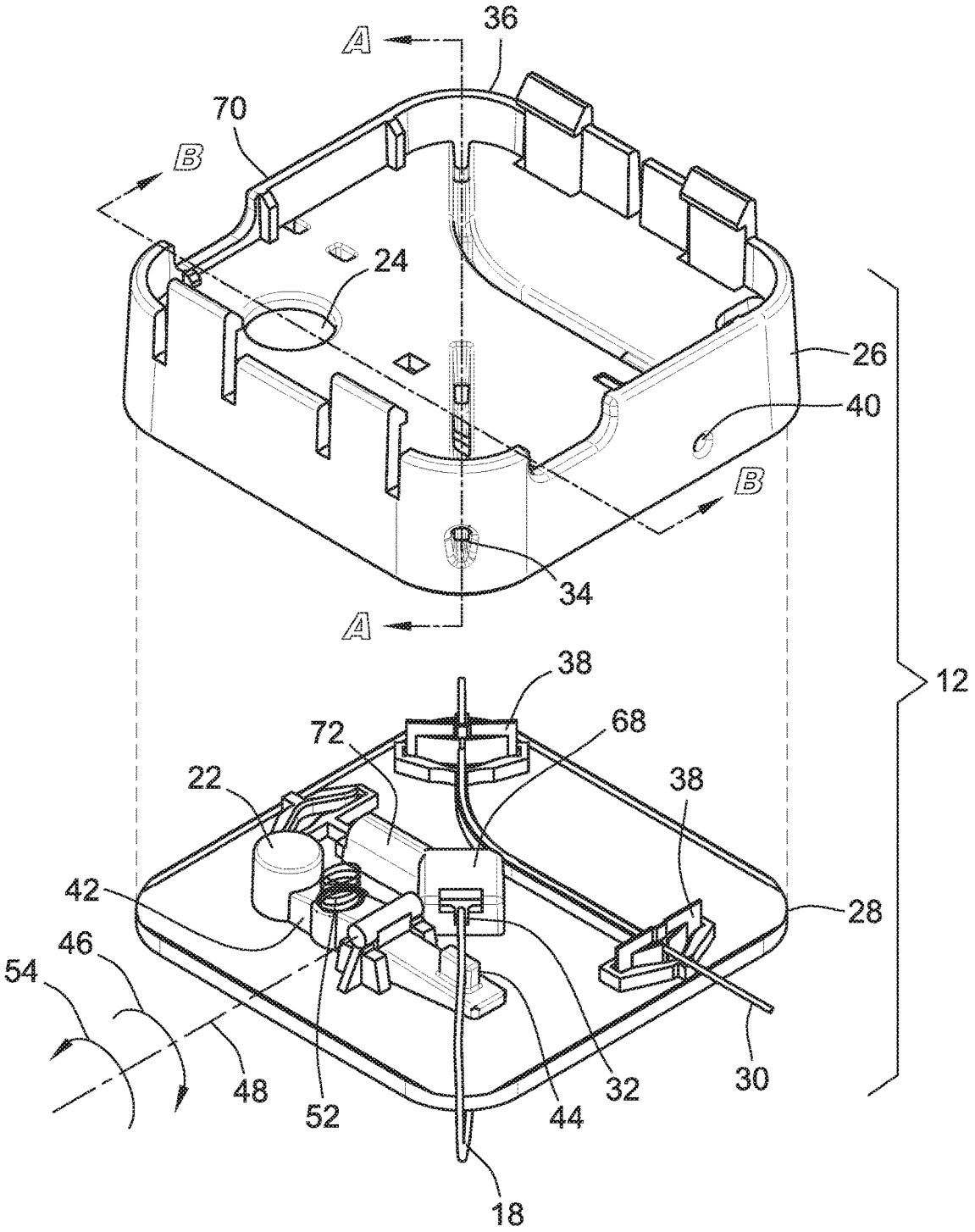
FIG. 3 is a perspective exploded view of a base of the security device of FIG. 1.

Turning now to FIG. 3, base 12 is shown in an exploded view with cover member 26 removed from a base plate 28 thereof. As can be seen in this view, cable 18 has a free end 30 which is not fixed within an interior of base 12. Rather, free end 30 is routed through a first aperture 32 formed in a pocket 68 of base plate 28. Free end 30 then passes out of a second aperture 34 formed in cover member 26. Although illustrated as a generally circular hole, second aperture 34 may also take the form of a vertically extending slot, with an open end at the top peripheral edge of cover member 26. Free end 30 is then wrapped around an item of retail merchandise such as that schematically shown in FIG. 1, and then back into a third aperture 36 (See FIG. 1) formed in cover member 26. Free end 30 then passes through a plurality of bite elements 38 mounted on base plate 28. These bite elements 38 permit continued passage of free end 30 therethrough and out of a fourth aperture 40 formed in cover member 26. Bite elements 38, however, will not allow passage of cable 18 therethrough in a direction reverse to that described above. In other words, once free and 30 is pulled out of fourth aperture 40 cable 18 will continue to tighten around the item of merchandise it is wound around. Once cable 18 is fully tightened around this item of merchandise, the tension in cable 18 is maintained by way of bite elements 38 as they will not permit cable 18 to be drawn back inward through fourth aperture 40.

It will be recognized that although a plurality of bite elements 38 are shown, a single bite element 38 may also be employed. Indeed, any element or elements that will only all passage of cable 18 therethrough in a single direction could be utilized. As one example, the illustrated embodiment shows a single bite element 38 positioned adjacent apertures 34, 36, respectively. Alternatively, multiple bite elements 38 could be positioned adjacent each aperture 34, 36. Further, as will be discussed below relative to FIG. 8, base 12 also offers an alternative cable routing using a fifth aperture 70 and a passage 72 which extends from pocket 68.

A rocker arm 42 is also positioned within base 12. As can be seen from inspection of FIG. 3, post 22 forms one end of rocker arm 42. At an opposite end of rocker arm 42, a tab 44 projects therefrom. Cable 18, when fully installed on an item of merchandise as described above, exerts a downward force against tab 44. This downward force causes rocker arm 42 to rotate in first rotational direction 46 about an axis 48 defined by a fulcrum portion 50 of rocker arm 42. If cable 18 is cut, however, the tension therein is no longer present and thus there is no longer a downward force exerted on tab 44.

Under such conditions, a biasing element 52 interposed between rocker arm 42 and cover member 26 rotates rocker arm 42 about axis 48 in second rotational direction 54 as shown. This causes post 22 to move downwardly through aperture 24 and out of contact with button 20 of anti-theft component 14 as discussed above relative to FIG. 2. As also discussed above, anti-theft component 14 is configured to still provide an indication when button 20 is not depressed. Further, in other embodiments, base 12 may incorporate its own indicator, e.g. audible, visual, etc., and associated circuitry for providing an indication when rocker arm 42 is no longer acted upon by the tension in cable 18. Such an embodiment has the added advantage of providing a redundant alarm in the event the anti-theft component 14 is inoperable or rendered inoperable.

Figure 4:
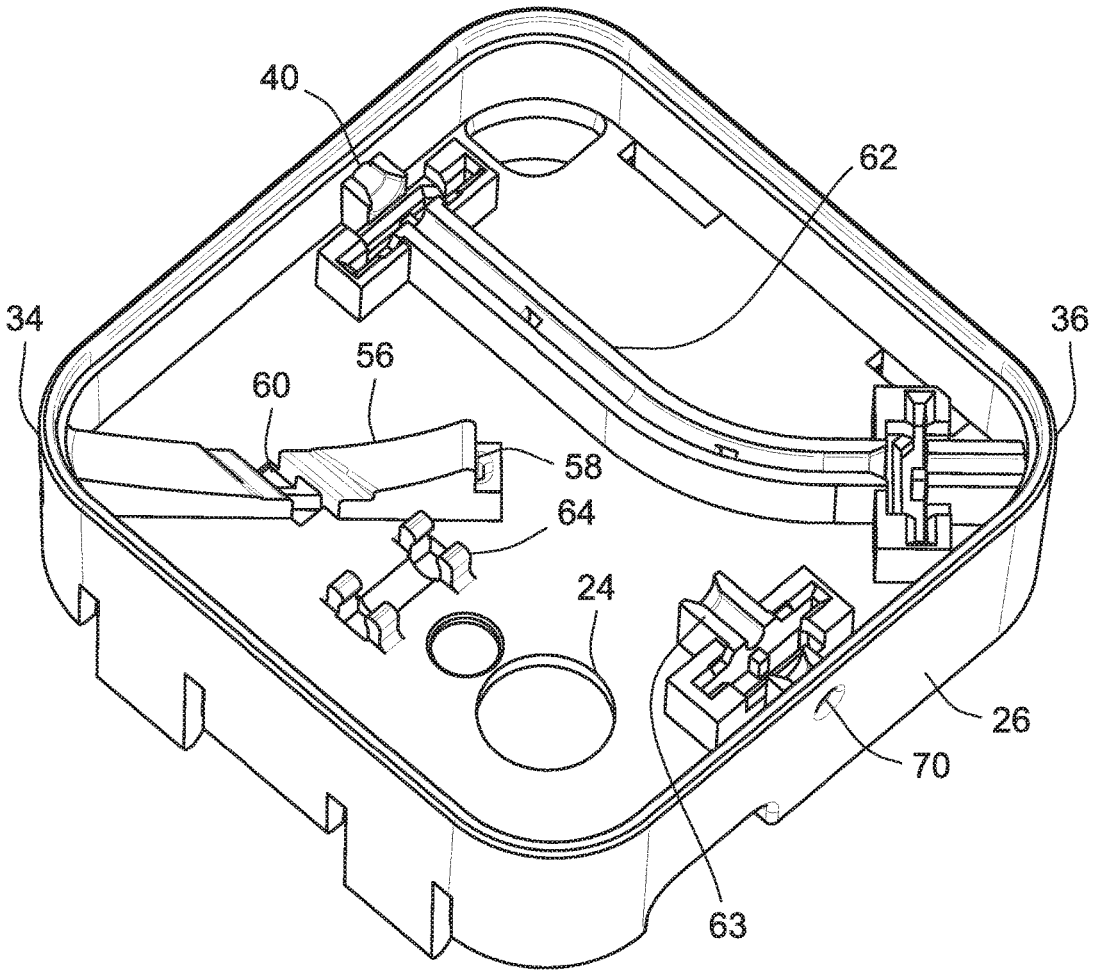
FIG. 4 is a cover member of the base of FIG. 3.

Turning now to FIG. 4, the interior of cover member 26 is illustrated. Cover member 26 includes a first track 56 which is alignable with first aperture 32 formed on base plate 28 (See FIG. 3). An aperture 58 is formed in first track 56 for passage of free end 30 of cable 18. First track 56 continues in its extent until second aperture 34 (See FIG. 3). As such, first track 56 defines a pathway for cable 18 as it is routed through base 12. A cut-out 60 is formed in first track 56. Cut-out 60 is arranged and sized to receive tab 44 discussed above relative to FIG. 3. A portion of cable 18 is exposed through cut-out 60 such that tab 44 is in contact with cable 18 as described above.

Cover member 26 also includes a second track 62 which extends between third and fourth apertures 36, 40. Second track 62 also functions to define a routing pathway for free end 30 of cable 18 as it is passed through base 12. As can also be seen in FIG. 4, clip elements 64 are formed on cover member 26 to rotatably receive fulcrum portion 50 of rocker arm 42 to permit the above-described rotation of rocker arm 42.

Figure 5:
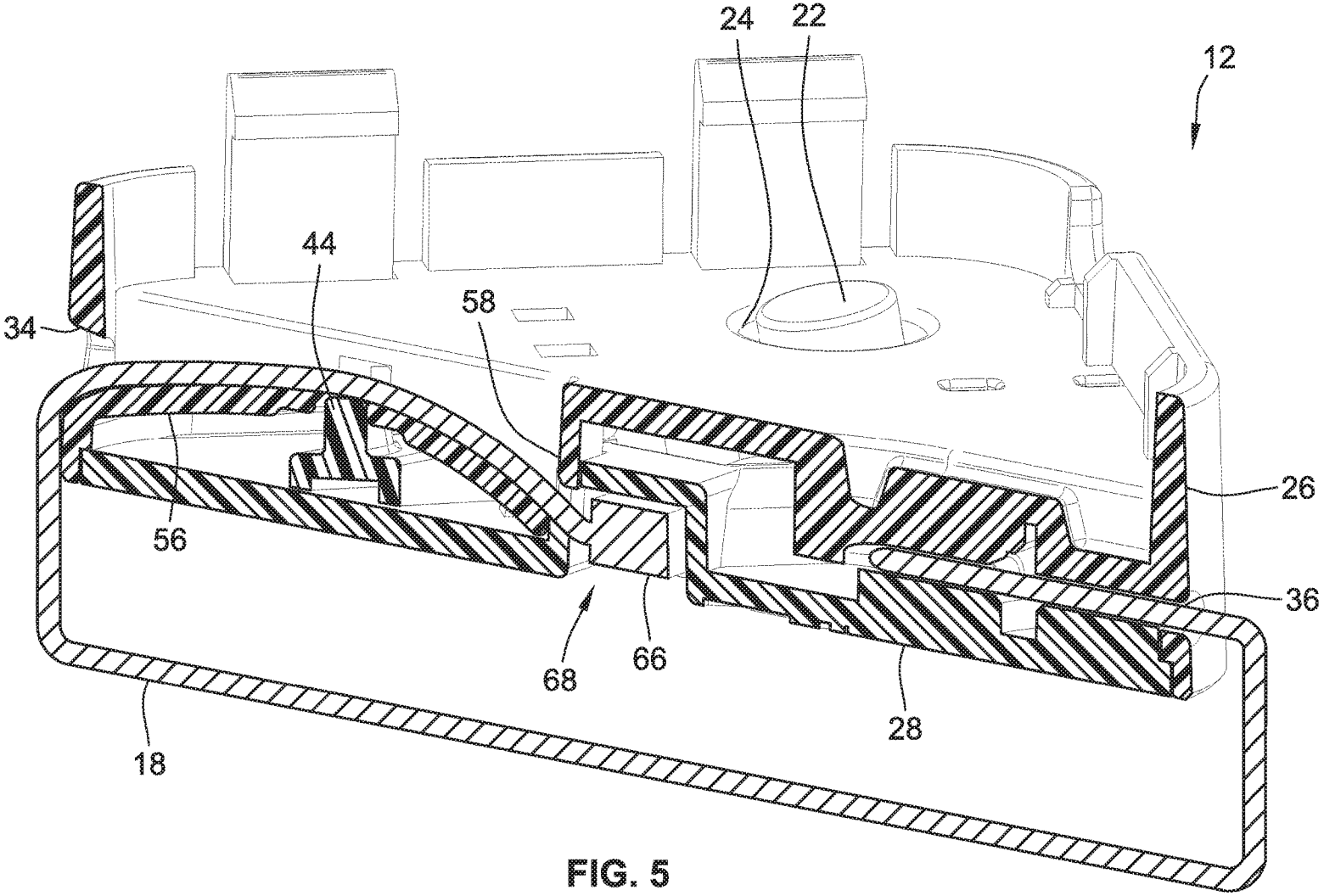
FIGS. 5-7 are cross sections of the base of FIG. 3 in several operational configurations.
Figure 8:
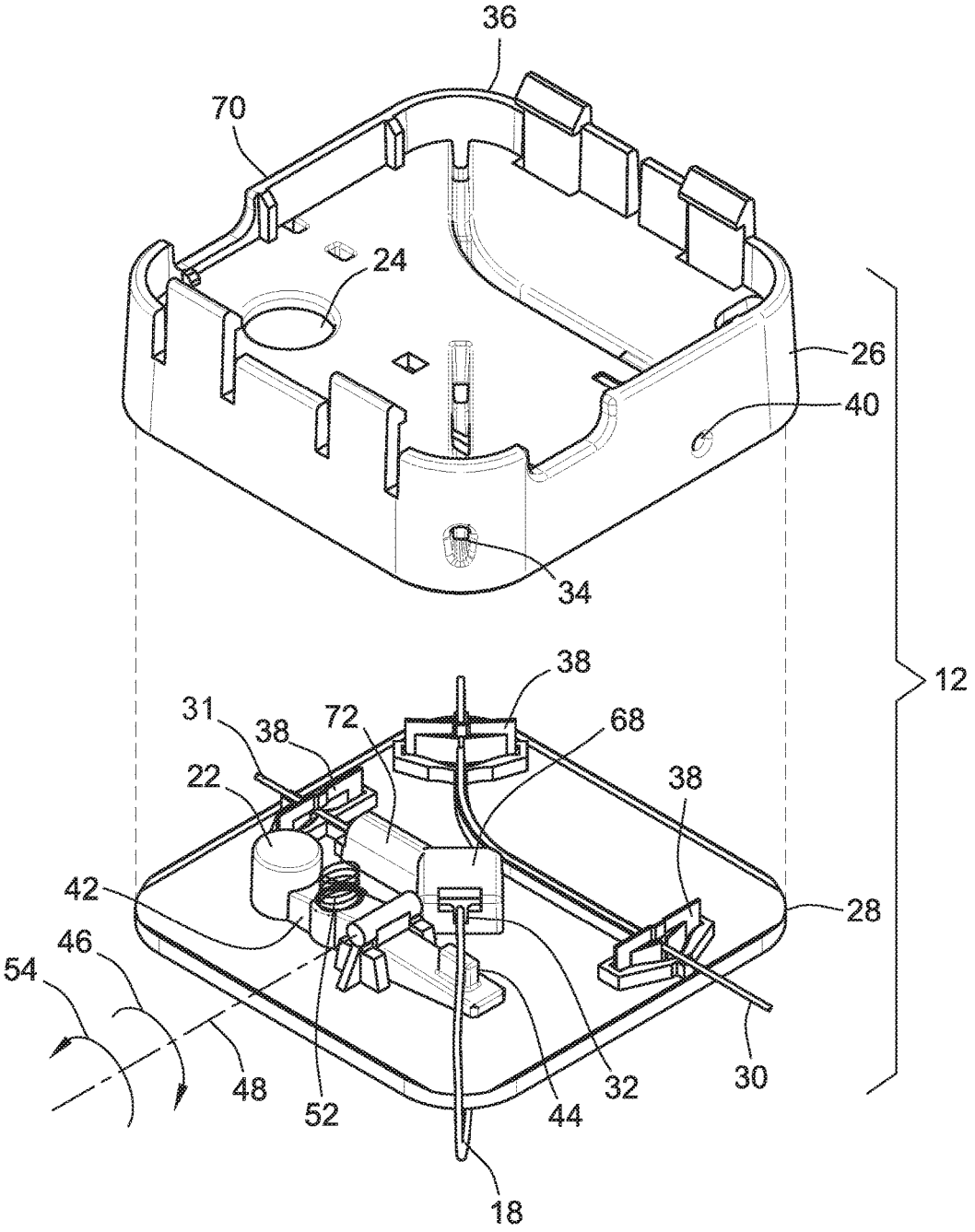
FIG. 8 is a perspective exploded view of the base of the security device of FIG. 1, showing an alternative cable routing thereof.

Turning now to FIG. 5, the routing of cable 18 is shown in cross-section. As can be seen therein, cable 18 passes through first track 56. The tension in cable 18 is sufficient enough to bias tab 44 as shown. As can also be seen in this view, cable 18 includes an enlarged end 66 which is received in pocket 68 formed in base plate 28. This enlarged end 66 is larger than apertures 32, 58 and thereby prevents cable 18 from being entirely pulled through base 12 when a pulling force is exerted on free end 30 as described above. As will be discussed in greater detail below relative to FIG. 8, however, cable 18 need not include an enlarged portion 66 when the alternative cable routing shown in FIG. 8 is utilized.

As will also be understood from inspection of FIG. 5, cable 18 is readily replaceable by a longer cable with an enlarged end 66 by simply cutting existing cable 18 and removing it from base 12. Thereafter, a new cable 18 which is longer may be utilized with base 12. As an advantageous result, base 12 can accommodate differing sizes of retail merchandise by simply utilizing different cable lengths at the user level. To achieve this advantage, the existing cable 18 is simply cut in the region between second and third apertures 34, 36. This will allow one cut portion of cable 18 to be removed from base 12 by pulling on free end 30. The other cut portion is removed from base 12 by pulling on enlarged end 66. Thereafter, a new cable 18 can be routed through base 12 as described above until the enlarged end 66 is received in pocket 68.

Figure 6:
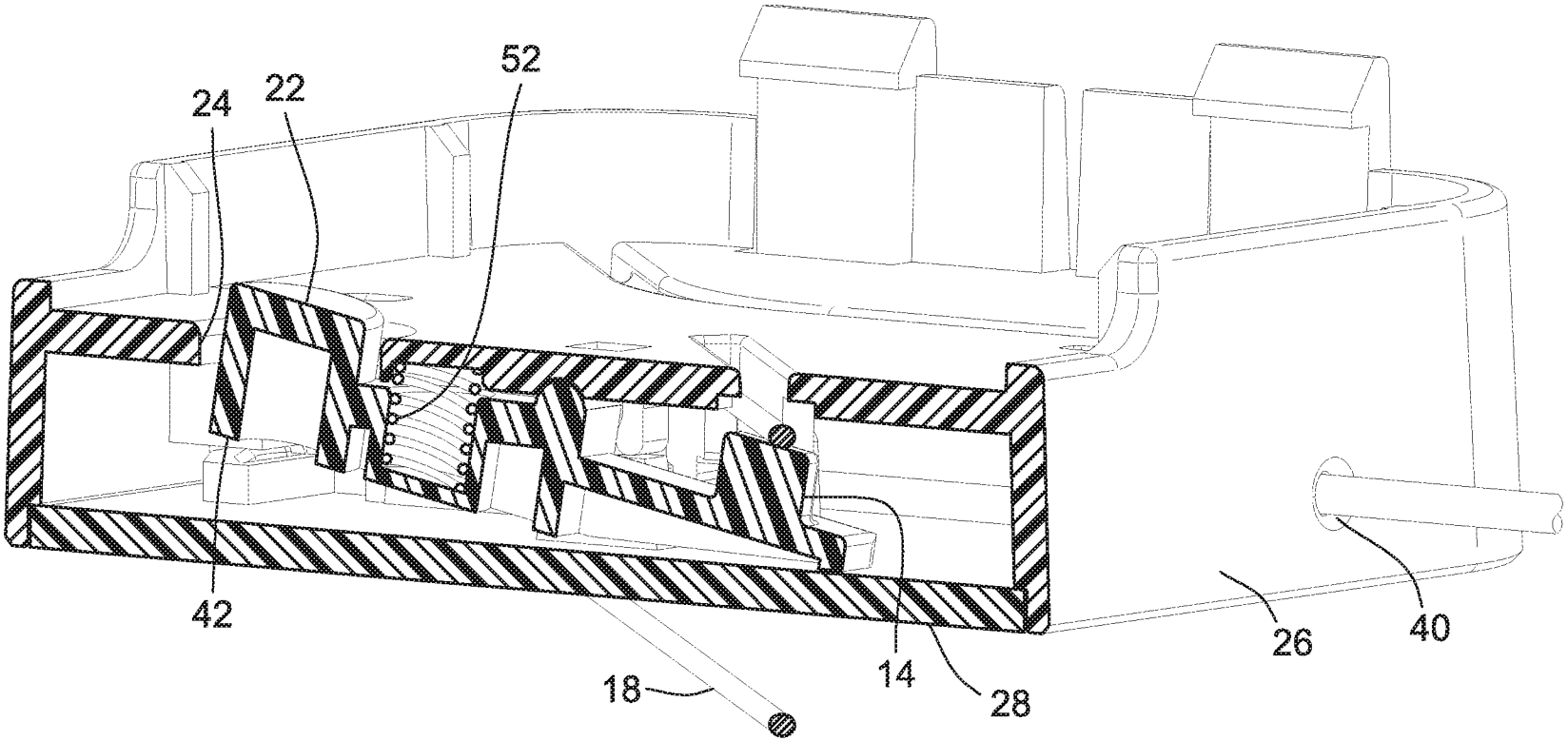
Figure 7:
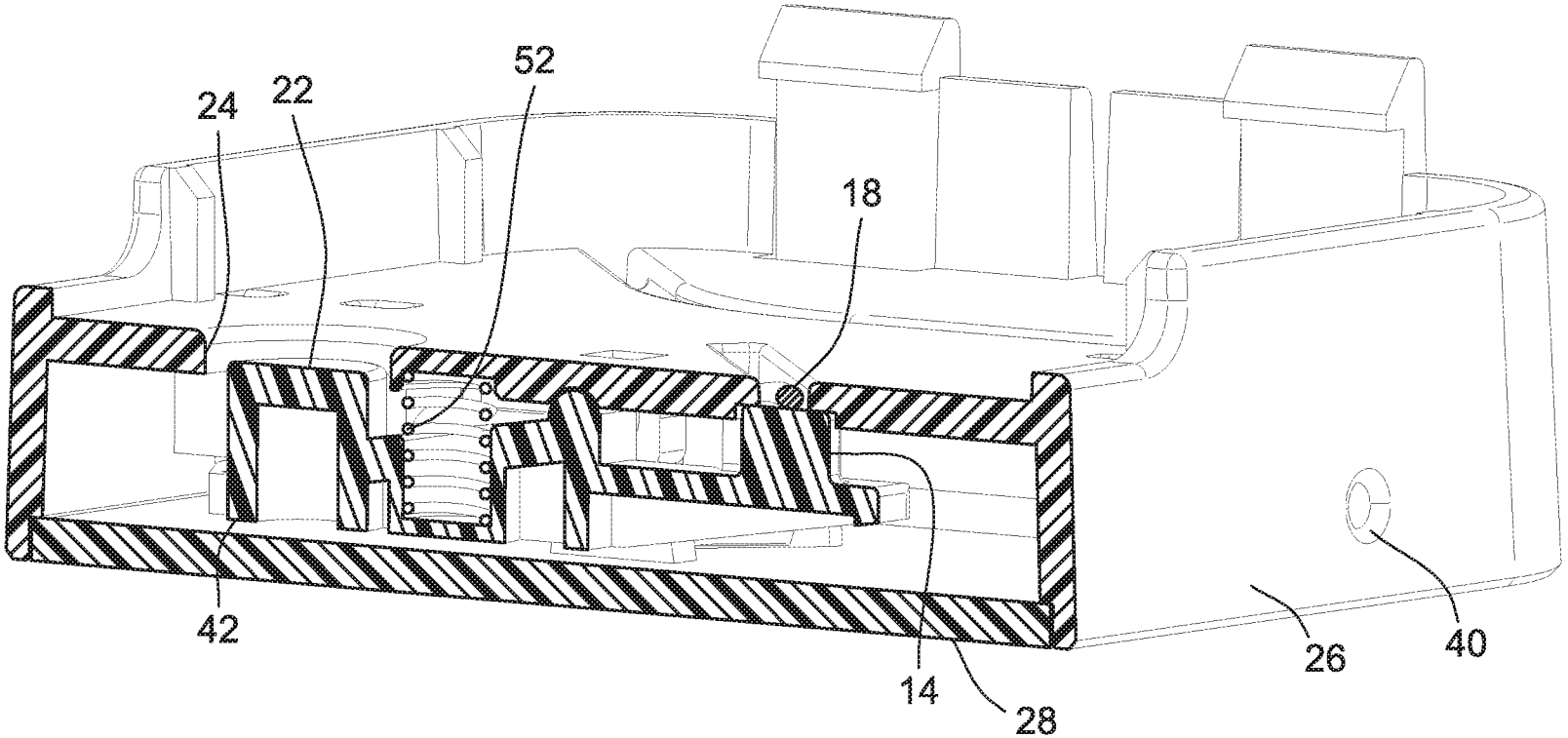

FIGS. 6 and 7 show cross-sections of base 12 and armed and disarmed configuration respectively. In the armed position shown in FIG. 6, post 22 extends through aperture 24 as shown. As discussed above, this is caused by a downward force exerted by cable 18 upon tab 44 as shown.

Turning now to FIG. 7, in the disarmed position, tension in cable 18 is no longer present. As a result, biasing member 52 acts against rocker arm 42 to rotate post 22 thereof downwardly through aperture 24. In the event that an anti-theft component 14 is attached to base 12 and is in an activated state, anti-theft component 14 will provide an indication as described above.

Turning now to FIG. 8, an alternative cable routing configuration is illustrated. In this embodiment, cable 18 need not incorporate an enlarged portion 66 which is trapped in pocket 68 as described above. Instead, one or more additional bite elements 38 are relied on to fix a first end 31 of cable 18 prior to routing its free end 30 through the base 12. Indeed, base plate 28 also includes a passage 72 which communicates with pocket 68. As can be seen in FIG. 8, and additional bite element 38 is situated in proximity to an end of passage 72. Although only a single bite element 38 is shown adjacent passage 72, additional bite elements 38 may be utilized.

Passage 72 and this additional bite element 38 are aligned with a fifth aperture 70 formed on cover member 26. The end of cable 18 which will remain fixed to base 12 is fed through passage 72, this additional bite element 38, and out of fifth aperture 70. Referring to the description above regarding the one-way operation of bite element 38, the bite element adjacent passage 72 is arranged such that it will not allow the end of cable 18 to pass back into base 12 through fifth aperture 70. As such, once the desired end of cable 18 is fed through passage 72, through bite element 38, and out of fifth aperture 70 as shown, this end is now fixed to base 12. Alternatively, this bite element 38 may be omitted and instead a knot may be formed in first end 31. This knot may then be trapped in bite element receiving structure 63 (See FIG. 4) which previously received the bite element discussed relative to FIG. 8. In either case, first end 31 is fixed to base 12.

Thereafter, the free end of cable 18 is fed through pocket 68, apertures 32, 58, first track 56, second aperture 34, around merchandise 16, through third aperture 36, second track 62, and out of fourth aperture 40 in the same manner as that described above relative to FIGS. 1-7. The advantage of the routing configuration shown in FIG. 8 is that cable 18 need not include an enlarged end 66 and is thus not a custom component. As such, "off the shelf" cable can be utilized. For example, standard 80 pound test fishing line may be used for cable 18. Another advantage with this routing configuration is that cable 18 may be routed as such when anti-theft component 14 is attached to base 12.

As described herein, the security device 10 and its associated base 12 advantageously overcome existing problems in the art by providing a cable-style security device with a free running end that can readily accommodate different shapes of retail merchandise. Further, this cable is readily replaceable relative to base 12 so that a user can use the same base 12 with larger sizes of retail merchandise. Lastly, base 12 is operable to work with surface mount anti-theft components which have a pressable button thereon. Such functionality is independent of the particular anti-theft methodology employed by anti-theft component 14. Indeed, all that is required is that anti-theft component 14 employ a depressible button as described above.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A security device, comprising:

an anti-theft component including a depressible button thereon;

a base configured to receive the anti-theft component, the base including a cable having a free end, the cable adapted to be routed through base and tensioned around an item of retail merchandise such that the free end of the cable extends outwardly from the base;

wherein the base is configured to depress the depressible button of the anti-theft component by tensioning of the cable around the item of retail merchandise.

2. The security device of claim 1, wherein the base includes a cover member and a base plate, wherein the cover member includes a plurality of tracks for routing the cable therethrough.

3. The security device of claim 2, wherein the base plate includes a rocker arm mounted thereto, wherein the rocker arm has a first end, a second end, the first end comprising post, and the second end comprising a tab.

4. The security device of claim 3, wherein the post is configured to depress the depressible button, and wherein the tab is configured to receive a portion of the cable seated tensioned against the tab.

5. The security device of claim 3, wherein the base includes at least one bite element configured for allowing passage of the cable through the at least one bite element in a first direction and prevent passage of the cable through the at least one bite element in a second direction.

6. The security device of claim 5, wherein the at least one bite element includes a plurality of bite elements.

7. The security device of claim 5, wherein the plurality of bite elements includes a first bite element and a second bite element, the first and second bite elements spaced apart from one another, and wherein the first and second bite elements extend into one of the plurality of tracks of the cover member.

8. The security device of claim 7, further comprising a pocket formed in the base, a passage communicating with the pocket, and a third bite element adjacent an end of the passage opposite an end of the passage which communicates with the pocket.

9. The security device of claim 2, wherein the plurality of tracks includes a first track and a second track.

10. The security device of claim 9, wherein the first path extends along a straight path, and wherein the second track extends along a partially curved track.

11. The security device of claim 10, wherein the first track includes an opening, wherein the tab of the rocker arm extends into the opening of the first track such that the cable will contact tab.

12. A base for a security device, comprising:

a cover member and a base plate;

a rocker arm rotatably mounted between the cover member and the base plate;

a cable having an end held by the base plate, and a free end routed through the cover and base plate, the cable arranged to exert a downward force on a portion of the rocker arm when in a tensioned state; and wherein a post of the rocker arm extends through an aperture formed in the cover member when the cable exerts the downward force on the portion of the rocker arm, such that the post is exposed above the cover member by tensioning the cable.

13. The security device of claim 12, wherein the cover member includes a plurality of tracks and apertures for routing the cable therethrough.

14. The security device of claim 12, wherein the portion of the rocker arm against which the cable exerts the downward force comprises a tab extending in a generally parallel orientation to the post.

15. The security device of claim 12, wherein the base includes at least one bite element configured for allowing passage of the cable through the at least one bite element in a first direction and prevent passage of the cable through the at least one bite element in a second direction.

16. The security device of claim 15, wherein the at least one bite element includes a plurality of bite elements, wherein the plurality of bite elements includes a first bite element and a second bite element, the first and second bite elements spaced apart from one another, and wherein the first and second bite elements extend into one of the plurality of tracks of the cover member.

17. The security device of claim 16, further comprising a pocket formed in the base, a passage communicating with the pocket, and a third bite element adjacent an end of the passage opposite an end of the passage which communicates with the pocket.

18. A method for securing an item of retail merchandise, comprising:

installing an anti-theft component onto a base;

routing a free end of a cable through the base;

wrapping the free end of the cable around an item of merchandise;

routing the free end of the cable back through the base after the step of wrapping the free end of the cable around the item of retail merchandise; and tensioning the cable to cause a post of a rocker arm to protrude from a cover plate of the base.

19. The method of claim 18, further comprising a step of depressing a depressible button of the anti-theft component using post of the base during or after tensioning the cable is complete.

20. The method of claim 18, wherein the step of routing the free end of the cable back through the base includes passing the cable through at least one bite element.

* * * * *